US007084892B2

(12) United States Patent
Sugiura

(10) Patent No.: US 7,084,892 B2
(45) Date of Patent: Aug. 1, 2006

(54) PHOTOPRINTER TAKING SHORTENED TIME FOR PRINTING

(75) Inventor: Ryusuke Sugiura, Osaka (JP)

(73) Assignee: Funai Electric Co., Ltd., Daito (JP)

( * ) Notice: Subject to any disclaimer, the term of this patent is extended or adjusted under 35 U.S.C. 154(b) by 162 days.

(21) Appl. No.: 10/920,775

(22) Filed: Aug. 18, 2004

(65) Prior Publication Data

US 2005/0041088 A1 Feb. 24, 2005

(30) Foreign Application Priority Data

Aug. 19, 2003 (JP) ..... 2003-295421

(51) Int. Cl.
*B41J 2/325* (2006.01)

(52) U.S. Cl. ..... 347/175

(58) Field of Classification Search ..... 347/175; 400/120.03

See application file for complete search history.

(56) References Cited

U.S. PATENT DOCUMENTS

| | | | | |
|---|---|---|---|---|
| 6,795,102 | B1 * | 9/2004 | Kokubo et al. | 347/175 |
| 6,943,815 | B1 * | 9/2005 | Machida et al. | 347/175 |
| 2003/0151656 | A1 * | 8/2003 | Kokubo et al. | 347/175 |

FOREIGN PATENT DOCUMENTS

| | | |
|---|---|---|
| JP | 9-99572 | 4/1997 |
| JP | 2000-94725 | 4/2000 |

OTHER PUBLICATIONS

Patent Abstracts of Japan, Publication No. 09-099572 dated Apr. 15, 1997, 1 pg.
Patent Abstracts of Japan, Publication No. 2000-094725 dated Apr. 4, 2000, 1 pg.

* cited by examiner

*Primary Examiner*—Huan Tran
(74) *Attorney, Agent, or Firm*—Osha Liang LLP

(57) ABSTRACT

In printing a plurality of color images successively, a photoprinter forms a cyan image of an n-th image and successively forms a yellow image of the (n+1)-th image while drawing back roll paper toward the paper feed source. The time required for printing a plurality of color images can thus be shortened.

5 Claims, 10 Drawing Sheets

PHOTOPRINTER TAKING SHORTENED TIME FOR PRINTING

BACKGROUND OF THE INVENTION

1. Field of the Invention

The present invention relates to a photoprinter printing a color image on roll paper having thermal color-developing layers for yellow, magenta and cyan formed on the roll paper.

2. Description of the Background Art

Japanese Patent Laying-Open Nos. 9-99572 and 2000-94725 disclose techniques regarding photoprinters printing a color image on roll paper having thermal color-developing layers for yellow, magenta and cyan formed on the roll paper. Conventional general photoprinters each have a thermal head, a fixing lamp for magenta images (hereinafter magenta image fixing lamp) and a fixing lamp for yellow images (hereinafter yellow image fixing lamp) that are arranged along a path along which the roll paper is fed. A color image is printed on the roll paper by the steps of:

(1) drawing out the roll paper toward a paper exit to the position where image formation is started (image formation start position);
(2) drawing back the roll paper toward a paper feed source while setting the temperature of the thermal head to a first temperature (at which respective thermal color-developing layers of magenta and cyan do not develop respective colors) to form a yellow image on the thermal color-developing layer for yellow;
(3) drawing out the roll paper toward the paper exit to the position where fixing of the yellow image is started (yellow image fixing start position);
(4) drawing back the roll paper toward the paper feed source while exposing the yellow image formed in step (2) with the yellow image fixing lamp and then fixing the yellow image;
(5) drawing out the roll paper toward the paper exit to the image formation start position;
(6) drawing back the roll paper toward the paper feed source while setting the temperature of the thermal head to a second temperature (at which the thermal color-developing layer for cyan does not develop the color) higher than the first temperature to form a magenta image on the thermal color-developing layer for magenta;
(7) drawing out the roll paper toward the paper exit to the position where fixing of the magenta image is completed (magenta image fixing complete position) while exposing the magenta image formed in step (6) with the magenta image fixing lamp and then fixing the magenta image;
(8) drawing back the roll paper toward the paper feed source while setting the temperature of the thermal head to a third temperature higher than the second temperature to form a cyan image on the thermal color-developing layer for cyan;
(9) drawing out the roll paper toward the paper exit, separating the image-formed part of the paper from the roll paper and discharging the separated paper; and
(10) drawing back the roll paper toward the paper feed source.

In the photoprinter, the above-described image formation start position is defined so that the rear end of a region of the roll paper on which the color image is to be printed (print region of the roll paper) is closer to the paper exit relative to the thermal head, the yellow image fixing start position is defined so that the rear end of the print region of the roll paper is closer to the paper exit relative to an exposure area of the yellow image fixing lamp, and the magenta image fixing complete position is defined so that the rear end of the print region of the roll paper is positioned at an exposure area of the magenta image fixing lamp.

The above-described conventional photoprinters transport the roll paper back and forth five times for printing the single color image. A resultant problem is a considerably long time required for successively printing a plurality of color images, for example, a plurality of photo images taken by a digital camera.

SUMMARY OF THE INVENTION

An object of the present invention is to provide a photoprinter taking a shortened time for printing a plurality of color images and improving convenience in the use of the printer by users in successively printing a plurality of color images.

In order to achieve the above-described object, a photoprinter of the present invention has the following configuration.

The photoprinter includes: a transport unit for transporting roll paper set in a paper feed unit, the roll paper having thermal color-developing layers for yellow, magenta and cyan respectively formed on the roll paper, a print unit having a thermal head, a magenta image fixing lamp and a yellow image fixing lamp that are arranged along a transport path along which the roll paper is transported, and operating the thermal head, the magenta image fixing lamp and the yellow image fixing lamp, and a control unit providing operation instructions to the transport unit and the print unit for printing a color image input to the photoprinter on the roll paper. The control unit gives instructions to the transport unit and the print unit for printing the color image, and the instructions are given to perform the first step of drawing out the roll paper toward a paper exit to an image formation start position, and thereafter drawing back the roll paper toward a paper feed source while setting temperature of the thermal head to a first temperature to form a yellow image on the thermal color-developing layer for yellow, the second step of drawing out the roll paper toward the paper exit to a position where fixing of the yellow image is to be started, thereafter drawing back the roll paper toward the paper feed source while exposing the yellow image formed in the first step using the yellow image fixing lamp and fixing the yellow image, the third step of drawing out the roll paper toward the paper exit to the image formation start position, and thereafter drawing back the roll paper toward the paper feed source while setting the temperature of the thermal head to a second temperature higher than the first temperature to form a magenta image on the thermal color-developing layer for magenta, the fourth step of drawing out the roll paper toward the paper exit while exposing the magenta image formed in the third step using the magenta image fixing lamp and fixing the magenta image, and the fifth step of drawing back the roll paper toward the paper feed source while setting the temperature of the thermal head to a third temperature higher than the second temperature to form a cyan image on the thermal color-developing layer for cyan. When a plurality of color images are to be formed successively by the photoprinter, the control unit instructs to perform the first step through to the fifth step for printing an n-th color image of the color images. The control unit instructs, after the n-th color image is processed by the transport unit and the print unit through the first step to the fourth step and after stopping drawing out of the roll paper for a certain period of time, to perform the first step for printing an (n+1)-th color image and drawing out the roll paper toward the paper exit to the image formation start position for the (n+1)-th color image. When the first step for printing the (n+1)-th color image is completed, the control unit instructs to perform the fifth step for printing the n-th color image without stopping drawing back of the roll paper toward the paper feed source.

With this configuration, before a cyan image of the n-th color image is formed, a yellow image of the (n+1)-th color image is formed. When the cyan image of the n-th color image is formed and the yellow image of the (n+1)-th color image is formed, the roll paper is transported in the same direction. Then, after the step of fixing a magenta image of the n-th color image is completed, the roll paper is drawn out to the image formation position for the (n+1)-th color image. Accordingly, the yellow image of the (n+1)-th color image and the cyan image of the n-th color image can be formed in one step.

In this way, in the process of printing a plurality of color images, the yellow image of a color image except for the first color image and the cyan image of the preceding color image can be formed in one step, so that the number of to-and-fro motions of the roll paper can be reduced, the time required for printing a plurality of color images can thus be shortened, and the convenience in the use by users can be improved.

After the n-th color image is processed through the first step to the fourth step, the control unit instructs to perform, after stopping drawing out of the roll paper for a certain period of time, the first step for printing the (n+1)-th color image and drawing out the roll paper toward the paper exit to the image formation start position for the (n+1)-th color image.

With this configuration, the region on which the (n+1)-th color image is to be printed, especially the leading-end area thereof can surely be prevented from being exposed by the magenta image fixing lamp before the color image is printed. Therefore, the quality of the (n+1)-th color image is not deteriorated.

When the first step for printing the (n+1)-th color image is completed, the control unit instructs to perform the fifth step for printing the n-th color image without stopping drawing back of the roll paper toward the paper feed source.

With this configuration, when the formation of the yellow image in printing the (n+1 )-th color image is completed and the formation of the cyan image in printing the n-th color image is to be done, the roll paper is not stopped from being transported. Thus, the time required for printing a plurality of color images can further be shortened and the convenience in the use by users in successively printing color images can further be improved.

As seen from the above, the present invention can shorten the time required for printing a plurality of color images and improve the convenience in the use by users.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

A photoprinter according to an embodiment of the present invention is hereinafter described.

Figure 1:
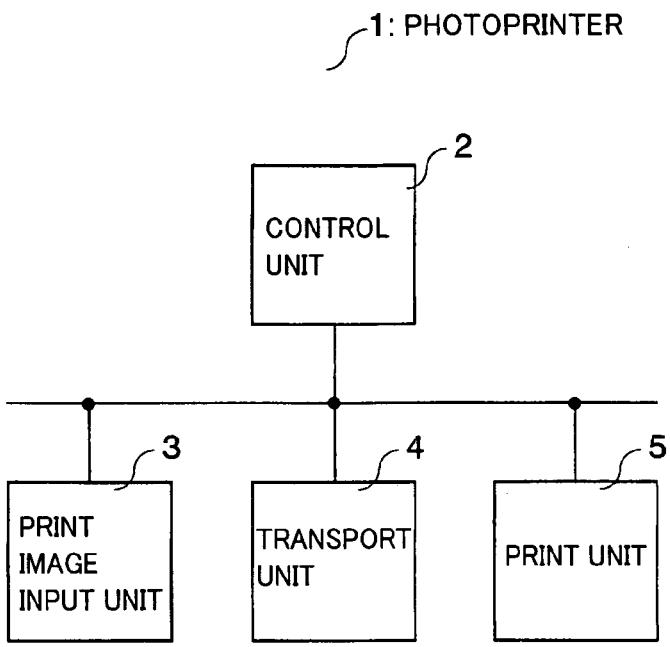
FIG. 1 shows a configuration of a photoprinter according to an embodiment of the present invention.

Referring to FIG. 1, photoprinter 1 of this embodiment includes a control unit 2 controlling operation of the photoprinter, a print image input unit 3 receiving a color image to be printed, a transport unit 4 transporting roll paper set in the photoprinter, and a print unit 5 printing a color image on the roll paper set in the photoprinter. Print image input unit 3 may be configured to receive, as an image to be printed, an image transmitted from such external equipment as personal computer or configured to read, as an image to be printed, an image stored in such a storage medium as memory card which is set in the photoprinter. Transport unit 4 can transport the roll paper in both of the direction toward a paper exit and the direction toward a paper feed source.

Figure 2:
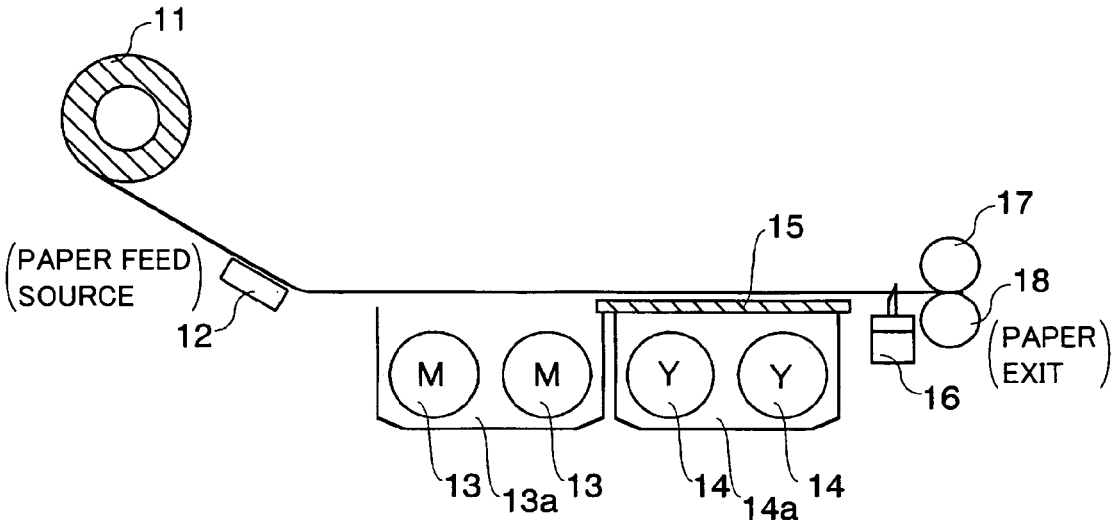
FIG. 2 shows a print unit of the photoprinter according to the embodiment of the present invention.

Referring to FIG. 2, roll paper 11 is set in a paper feed unit. Roll paper 11 is so-called TA (Thermo-Autochrome) paper having respective thermal color-developing layers for yellow, magenta and cyan. A thermal head 12 makes thermal recordings with the temperature varied in such manner that respective temperatures are set for respective thermal color-developing layers of yellow, magenta and cyan. A fixing lamp for magenta images (magenta image fixing lamp) 13 fixes an image formed on the thermal color-developing layer for magenta. A fixing lamp for yellow images (yellow image fixing lamp) 14 fixes an image formed on the thermal color-developing layer for yellow.

A platen roller (not shown) is placed to face thermal head 12 with roll paper 11 therebetween. Magenta image fixing lamp 13 and yellow image fixing lamp 14 are housed in respective reflectors 13*a* and 14*a* that surround respective bottom surfaces and side surfaces of the lamps. A shutter 15 is sized to cover the whole top surface of one of reflectors 13*a* and 14*a*. Shutter 15 is mounted to freely move in the direction in which roll paper 11 is transported, between the position where the shutter covers the whole top surface of reflector 13*a* and the position where the shutter covers the whole top surface of reflector 14*a*. Here, a mechanism for moving shutter 15 is not shown. A cutter 16 cuts roll paper 11. Cutter 16 moves in the direction of the width of roll paper 11 (perpendicularly to the plane of this drawing) to cut roll paper 11. Further, paper-discharge rollers 17 and 18 are provided.

Although no transport roller transporting roll paper 11 is shown in FIG. 2, transport unit 4 is placed to transport roll paper 11 in both of the direction toward the paper exit and the direction toward the paper feed source.

An operation of printing a color image input to photoprinter 1 is now described according to this embodiment. When a single color image is input, photoprinter 1 of this embodiment prints the color image through a process similar to that of the conventional photoprinters. Then, the operation of printing an input color image is first described. In this embodiment, control unit 2 of photoprinter issues instructions to transport unit 4 and print unit 5 to perform predetermined operations as described below. It is noted that, the operations of transport unit 4 and print unit 5 according to the operation instructions from control unit 2 of photoprinter 1 are herein generally described as operations of photoprinter 1.

Figure 3A:
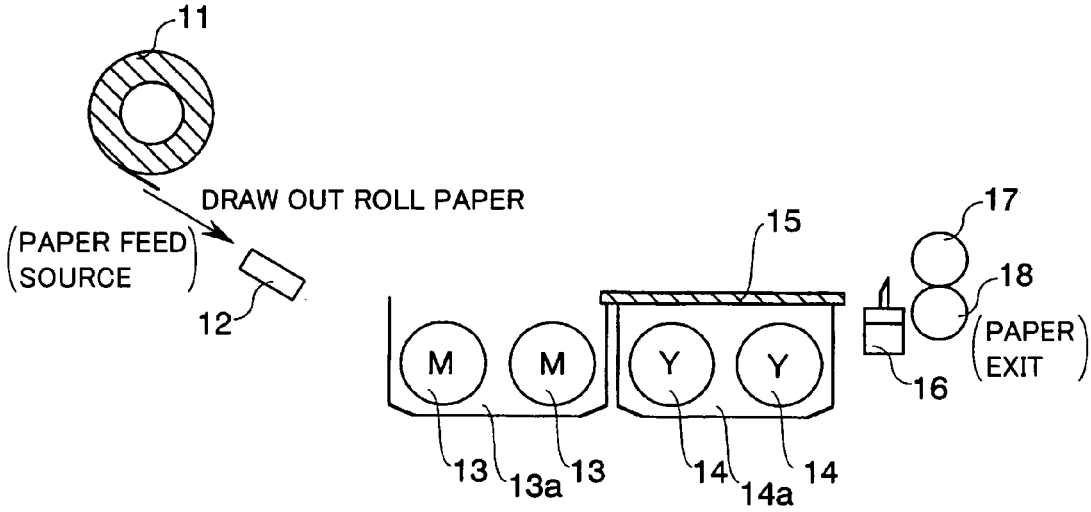
FIGS. 3A to 11B illustrate respective steps of printing processes of the photoprinter according to the embodiment of the present invention.
Figure 3B:
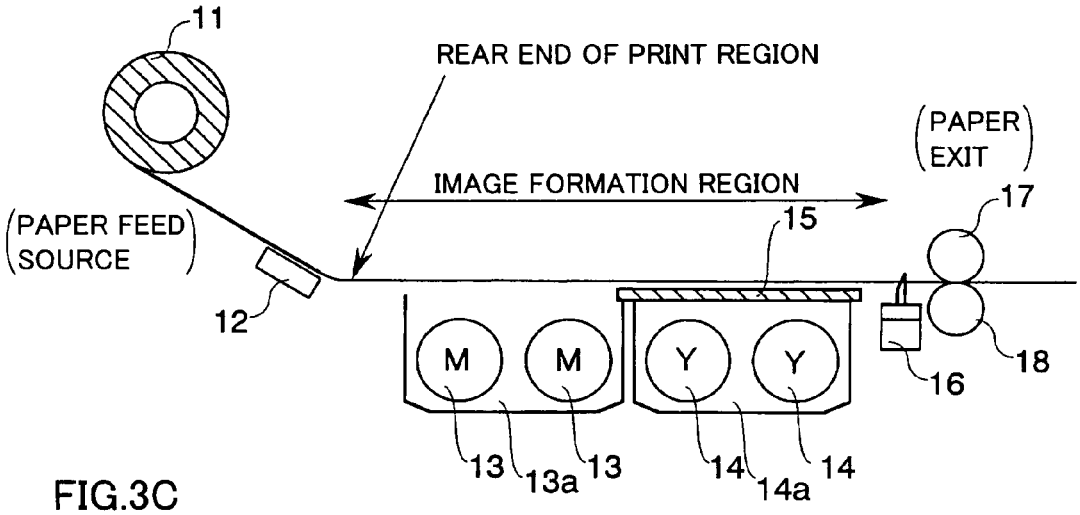

When photoprinter 1 prints no color image, namely in standby mode, roll paper 11 is rolled up as shown in FIG. 3A. Receiving a request to print an input color image, photoprinter 1 draws out roll paper 11 to an image formation region and stops the transport of roll paper 11 (see FIG. 3B). This image formation region is defined so that the rear end of a region of roll paper 11 on which the color image is to be printed (print region of roll paper 11) is located closer to the paper exit relative to thermal head 12.

Figure 3C:
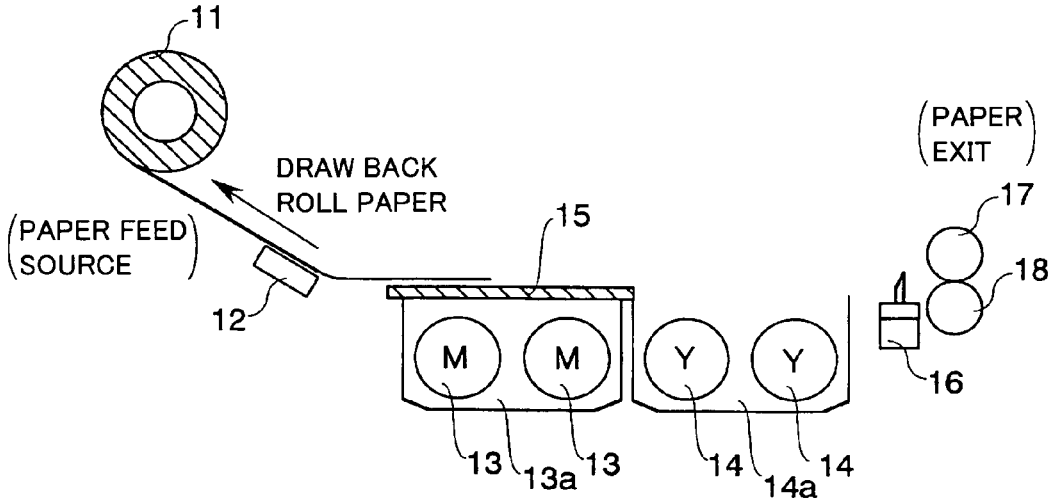
Figure 4A:
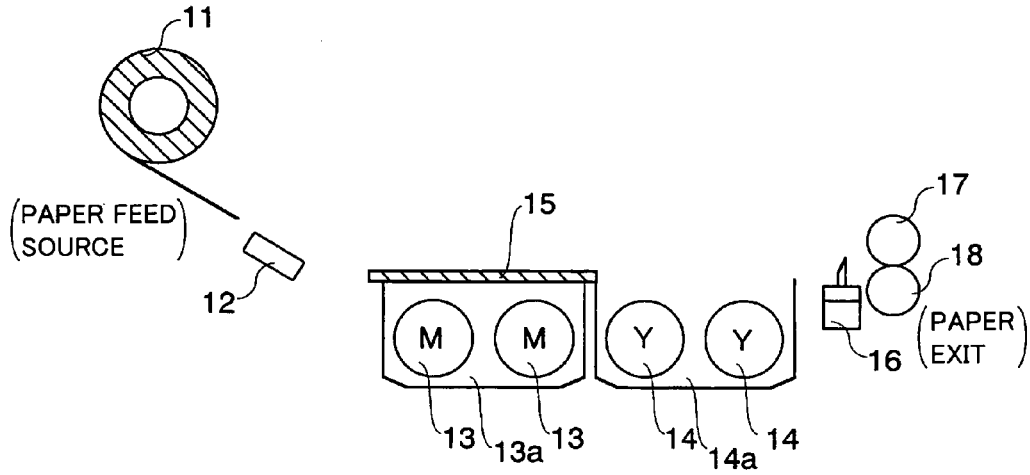
Figure 4B:
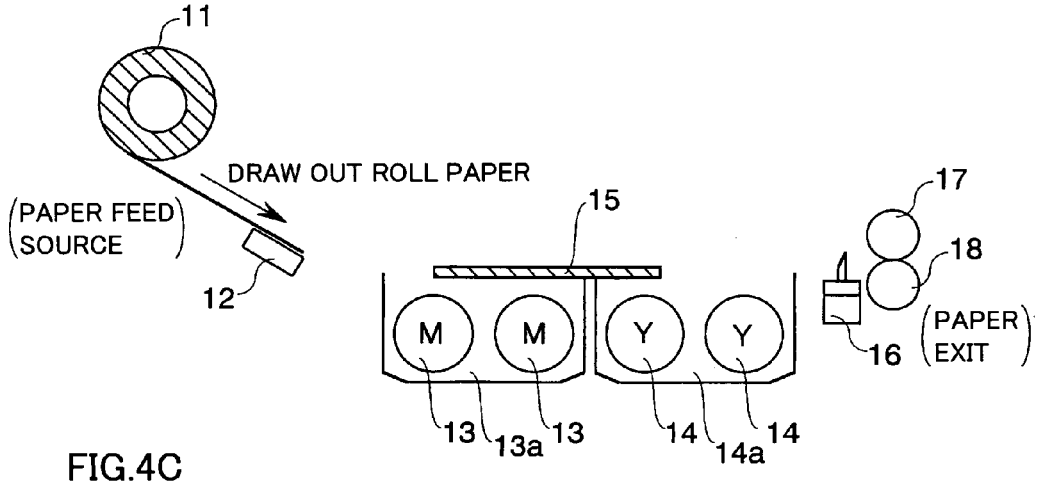
Figure 4C:
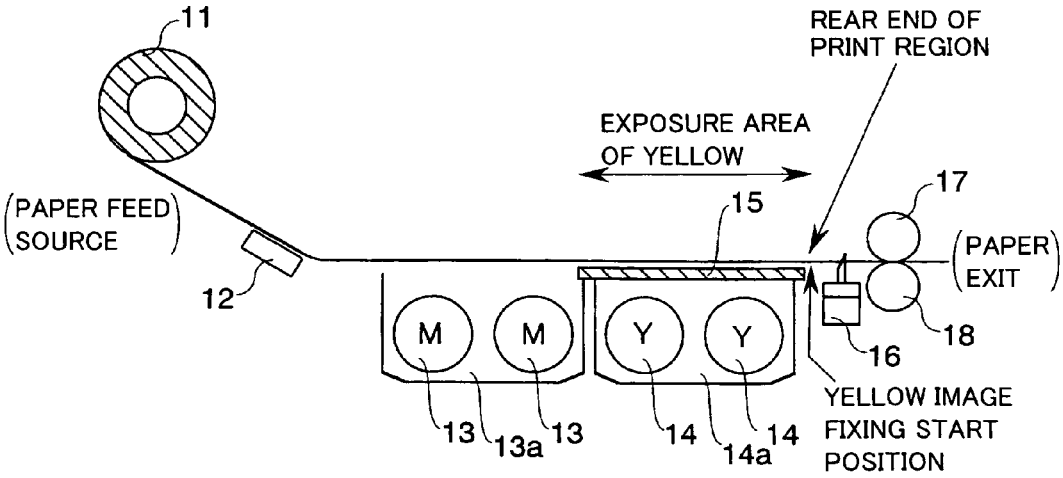

Photoprinter 1 then draws back roll paper 11 toward the paper feed source while setting the temperature of thermal head 12 to a first temperature (at which respective thermal color-developing layers for magenta and cyan do not develop respective colors) at which an image is formed on the thermal color-developing layer for yellow to form the yellow image on roll paper 11 (see FIG. 3C). After the formation of the yellow image through thermal head 12 is completed, photoprinter 1 stops the transport of roll paper 11 (see FIG. 4A) and thereafter draws out roll paper 11 toward the paper exit (see FIG. 4B). Then, when roll paper 11 is drawn out to a yellow image fixing start position, photoprinter 1 stops the transport of roll paper 11 (see FIG. 4C). The yellow image fixing start position is defined so that the rear end of the print region of roll paper 11 is located closer to the paper exit relative to an exposure area of yellow image fixing lamp 14. At this time, shutter 15 covers the whole top surface of reflector 14*a* in which yellow image fixing lamp 14 is held.

Figure 5A:
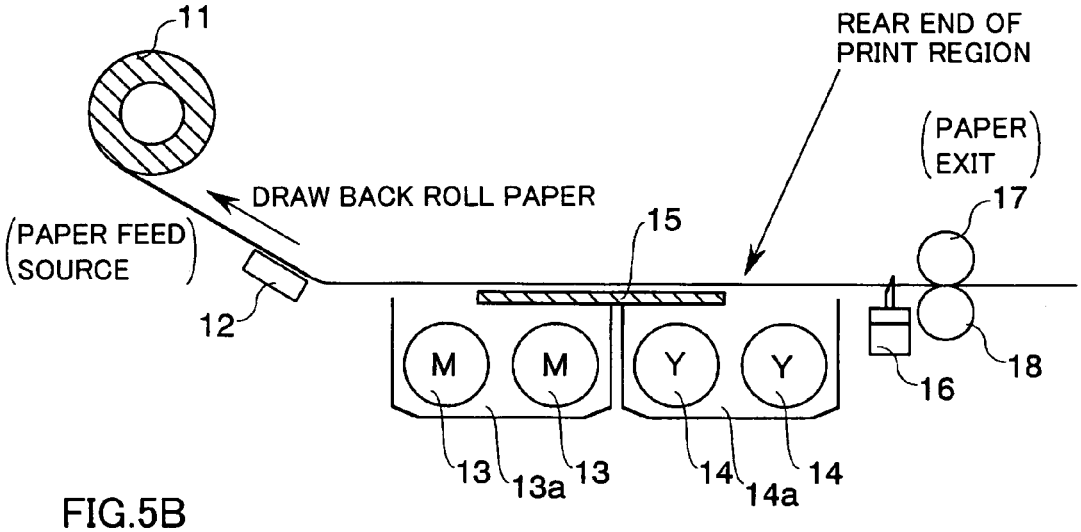
Figure 5B:
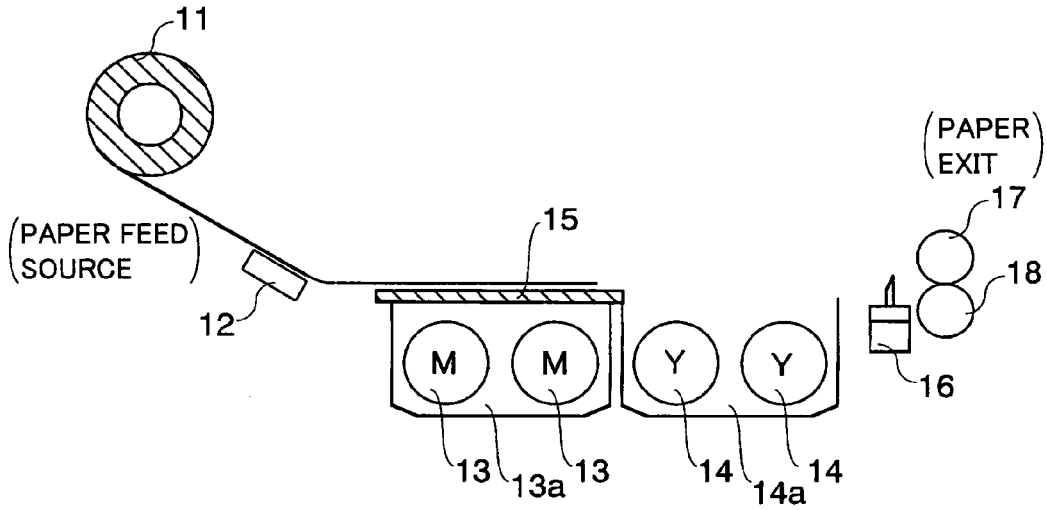

Photoprinter 1 turns on yellow image fixing lamp 14 and draws back roll paper 11 toward the paper feed source. When the rear end of the print region of roll paper 11 reaches one of the ends of shutter 15 that is closer to the paper exit, shutter 15 moves toward the paper feed source together with roll paper 11 (see FIG. 5A). Accordingly, the area of roll paper 11 on which the yellow image is printed this time is exposed by yellow image fixing lamp 14 and the yellow image is fixed. When shutter 15 reaches the position where shutter 15 covers the whole top surface of reflector 13*a* in which magenta image fixing lamp 13 is held, shutter 15 stops at this position. After the entire area of roll paper 11 where the yellow image is formed with yellow image fixing lamp 14 is exposed, photoprinter l stops the transport of roll paper 11 toward the paper feed source and turns off yellow image fixing lamp 14 (see FIG. 5B). At this time, it is preferable to stop the transport of the roll paper when the leading end of roll paper 11 is positioned closer to the paper feed source relative to the exposure area of yellow image fixing lamp 14, since the distance over which roll paper 11 is transported can be reduced and accordingly the time required for printing the color image can be shortened.

Figure 5C:
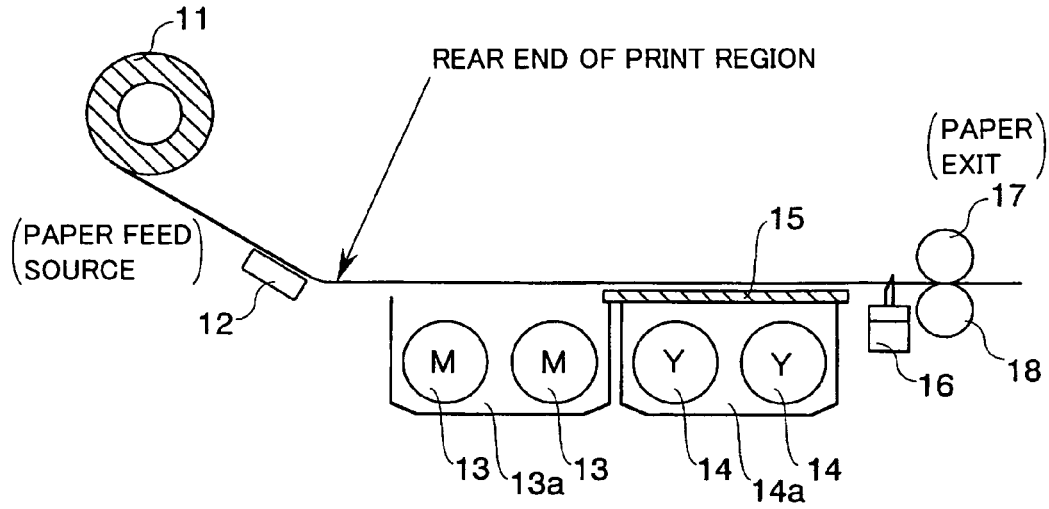
Figure 6A:
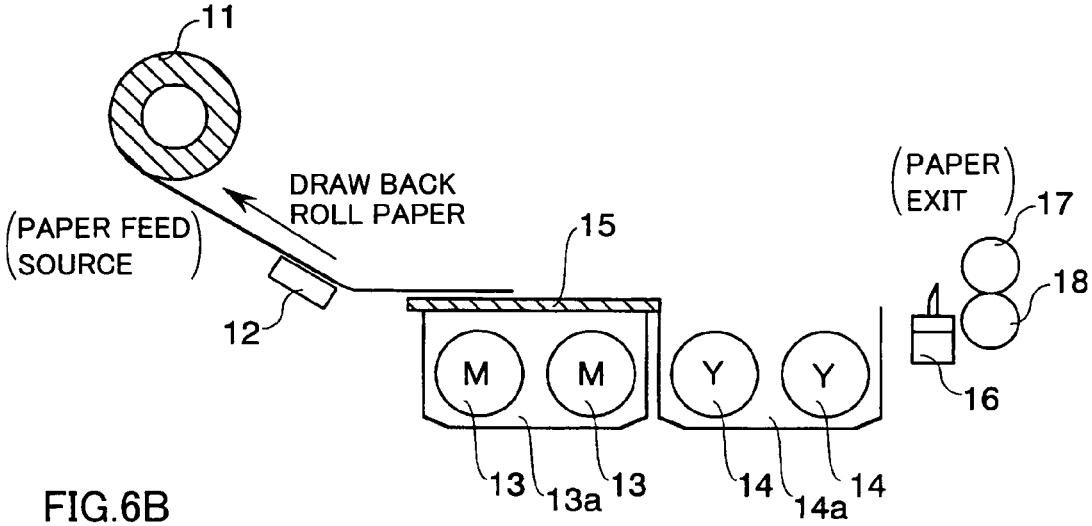
Figure 6B:
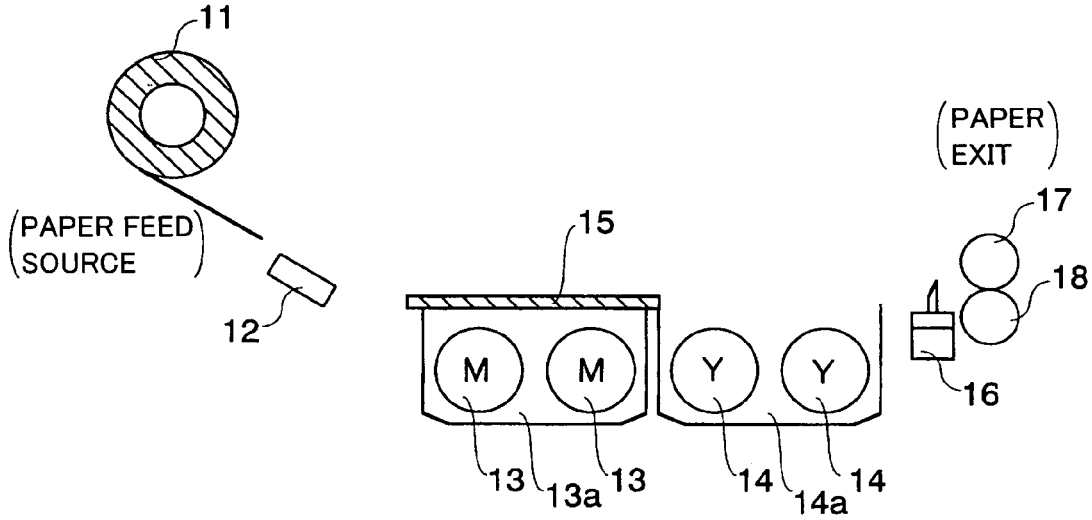
Figure 6C:
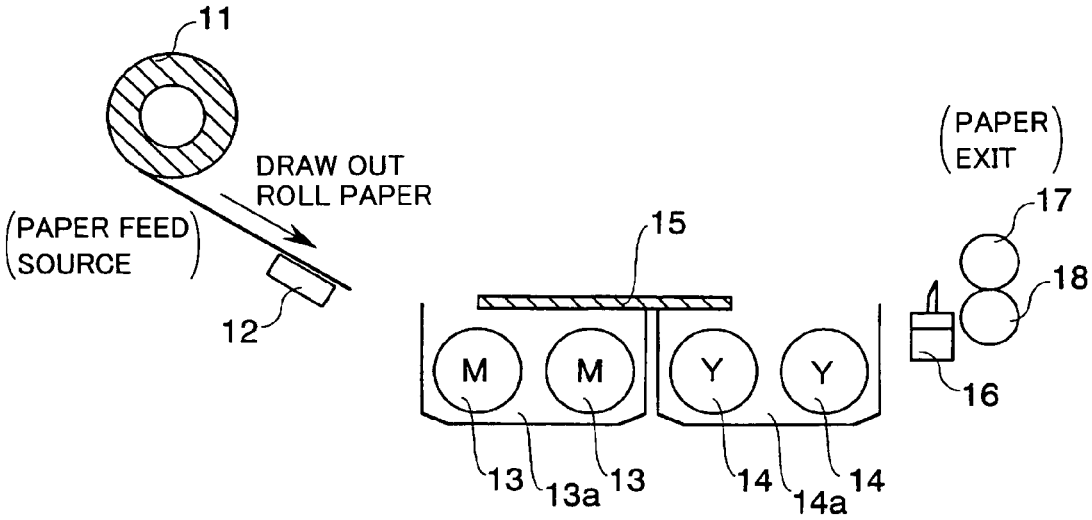

Then, photoprinter 1 draws out roll paper 11 to the image formation region and then stops the transport of roll paper 11 (see FIG. 5C). While thereafter drawing back roll paper 11 toward the paper feed source, photoprinter 1 sets the temperature of thermal head 12 to a second temperature (at which the thermal color-developing layer for cyan does not develop the color) at which an image is formed on the thermal color-developing layer for magenta and thereby forms the magenta image on roll paper 11 (see FIG. 6A). The second temperature is higher than the first temperature. After the formation of the magenta image through thermal head 12 is completed, photoprinter 1 stops the transport of roll paper 11 (see FIG. 6B). Then photoprinter 1 turns on magenta image fixing lamp 13, draws out roll paper 11 toward the paper exit, exposes the region of roll paper 11 where the magenta image is formed with magenta image fixing lamp 13 to fix the magenta image (see FIG. 6C). At this time, shutter 15 moves toward the paper exit to reach the position where shutter 15 covers the whole top surface of reflector 14*a* housing yellow image fixing lamp 14. Then, shutter 15 stops at this position.

Figure 7A:
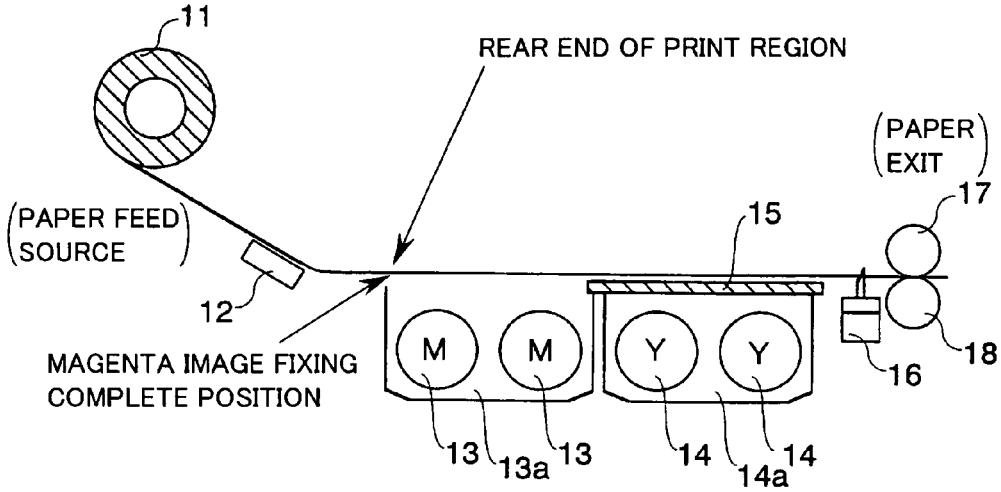

After photoprinter 1 draws out roll paper 11 to a magenta image fixing complete position, photoprinter 1 stops the transport of roll paper 11 (see FIG. 7A). After a certain time from the time when the transport of roll paper 11 is stopped, magenta image fixing lamp 13 is turned off. The magenta image fixing complete position is the position where the rear end the print region of roll paper 11 is within the exposure area of magenta image fixing lamp 13 and the remaining region of roll paper 11 on which the color image is not printed is almost out of the exposure area of magenta image fixing lamp 13. In other words, the magenta image fixing complete region is the region where any region of roll paper 11 on which no color image is to be formed is not substantially exposed by magenta image fixing lamp 13.

Figure 7B:
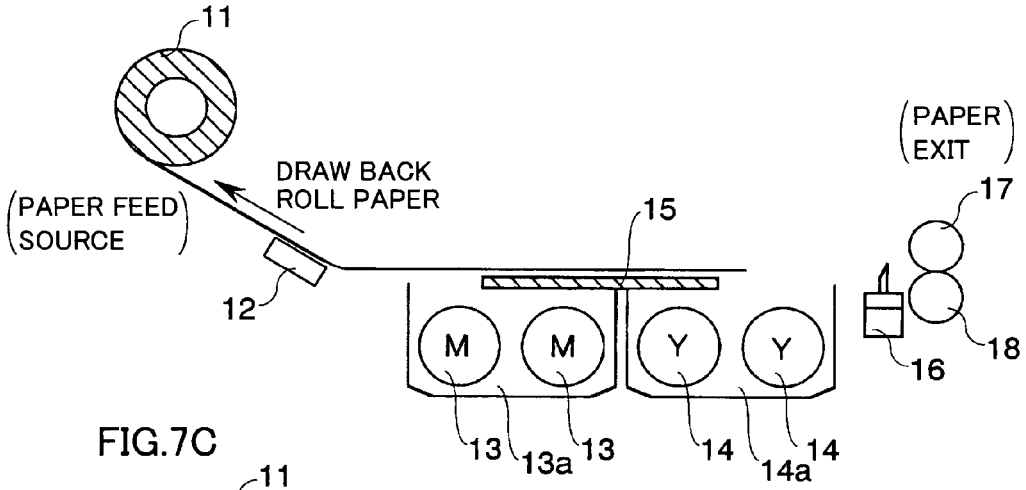
Figure 7C:
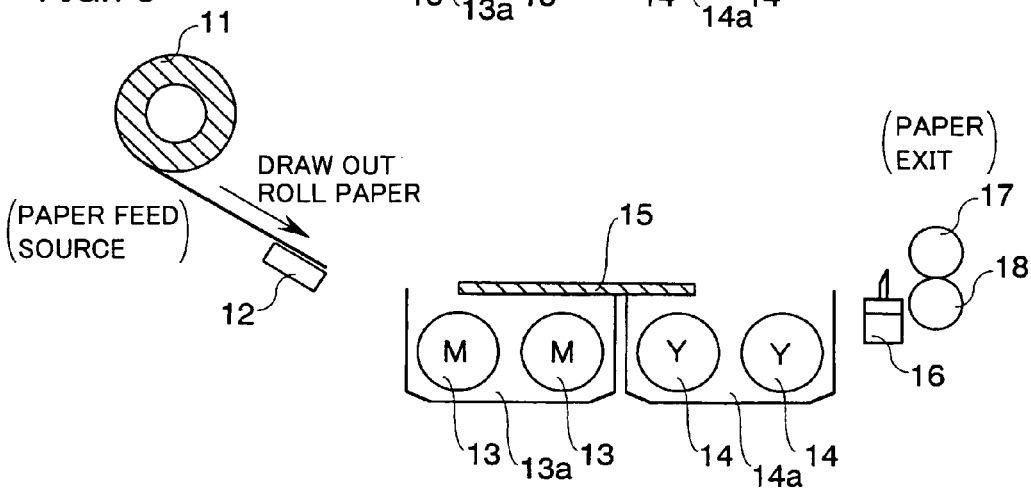
Figure 8A:
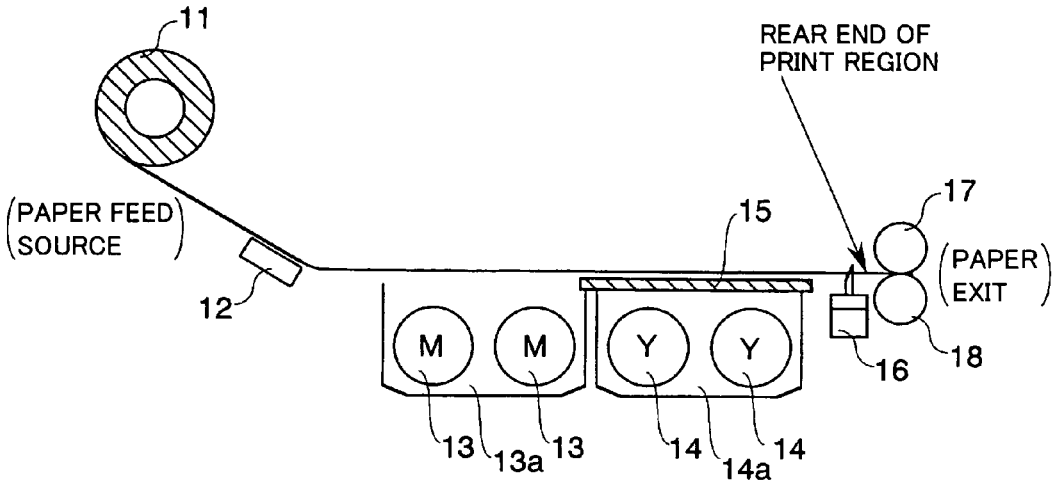
Figure 8B:
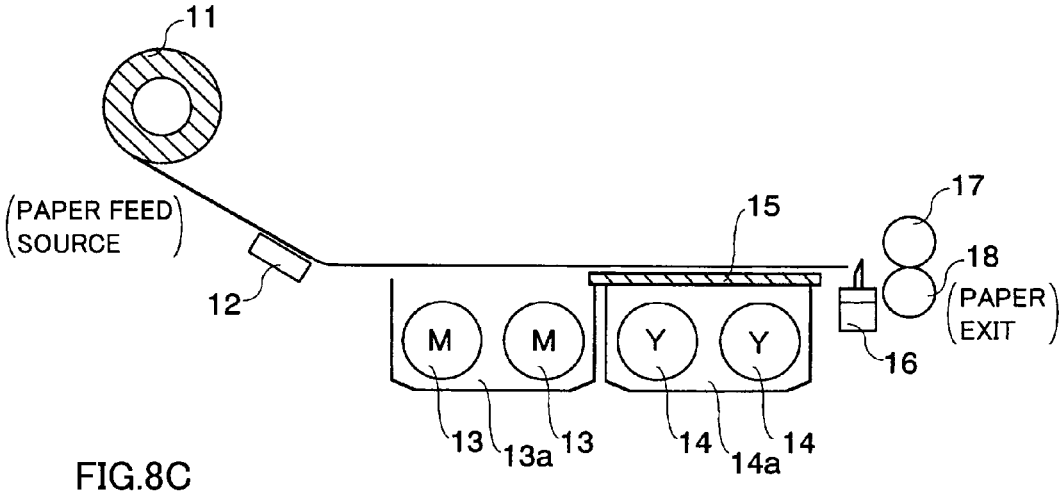
Figure 8C:
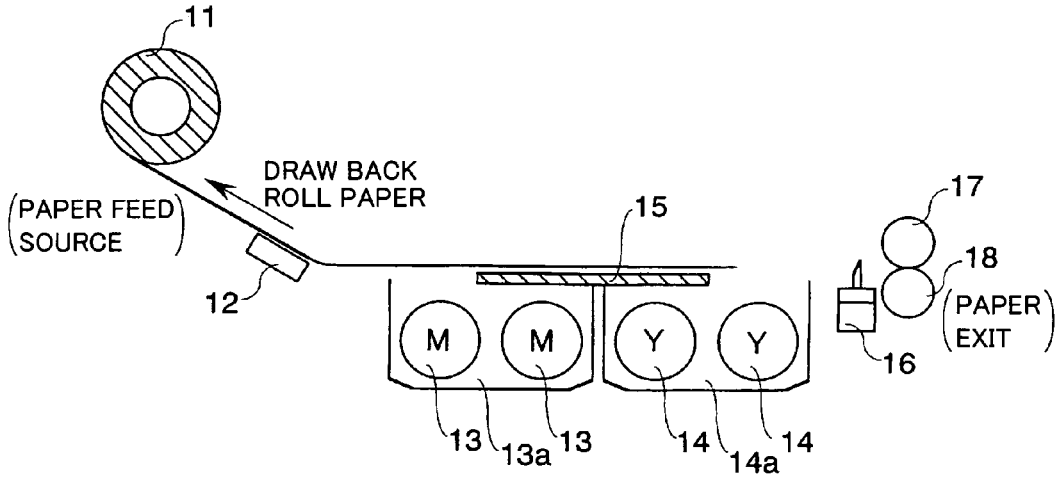

While drawing back roll paper 11 toward the paper feed source, photoprinter 1 sets the temperature of thermal head 12 to a third temperature at which an image is formed on the thermal color-developing layer for cyan to form the cyan image on roll paper 11 (see FIG. 7B). The third temperature is higher than the second temperature. After the formation of the cyan image is completed, photoprinter 1 stops the transport of roll paper 11. Then, photoprinter 1 draws out roll paper 11 toward the paper exit (see FIG. 7C). When the rear end of the print region of roll paper 11 reaches the position closer to the paper exit relative to the position where cutting is to be effected by cutter 16, photoprinter 1 stops the transport of roll paper 11 (see FIG. 8A) and moves cutter 16 in the direction of the width of roll paper 11 to separate the region with the color image printed thereon from roll paper 11 (see FIG. 8B). The separated portion of the roll paper is discharged by paper-discharge rollers 17 and 18. Photoprinter 1 thereafter draws back roll paper 11 toward the paper feed source (see FIG. 8C). When roll paper 11 is drawn back to the position as shown in FIG. 3A, this operation is completed.

It is seen from the above that photoprinter 1 of this embodiment moves roll paper 11 back and forth five times in printing a single color image.

When a plurality of images are input, photoprinter 1 operates as described below. Photoprinter 1 starts printing a first (n-th) color image to follow the process including the steps shown in and described in connection with FIGS. 3A to 7A and thereby fix a yellow image and a magenta image of the first (h-th) image on the roll paper. After stopping transport of roll paper 11, photoprinter 1 sufficiently exposes the image formation region where the first image is formed using magenta image fixing lamp 13. After a certain predetermined time for fixing the magenta image, magenta image fixing lamp 13 is turned off.

Figure 9A:
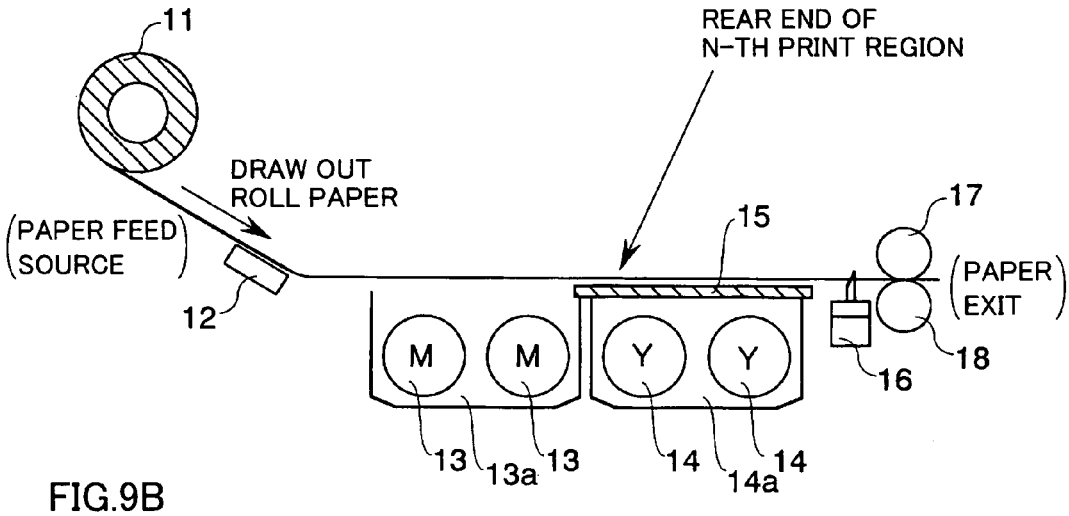
Figure 9B:
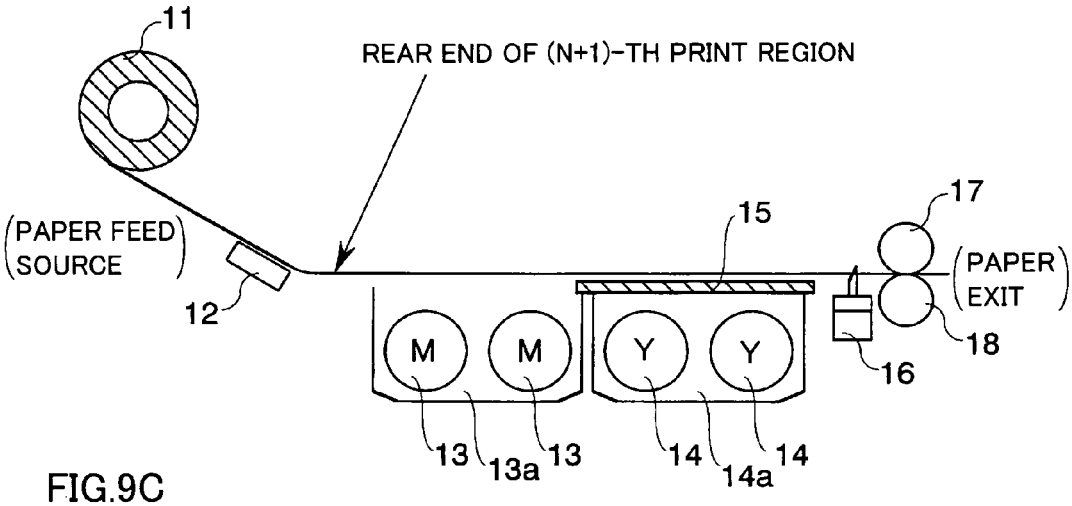
Figure 9C:
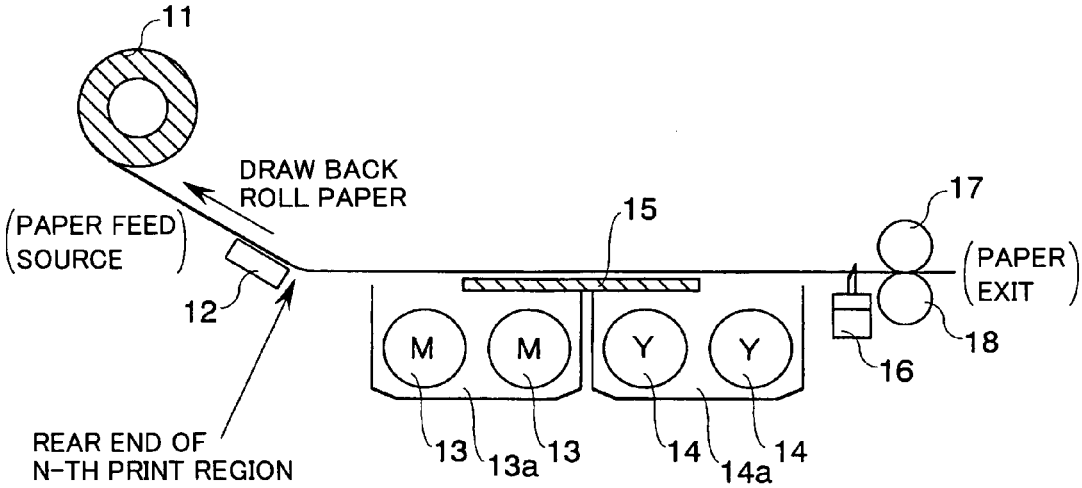

Then, photoprinter 1 draws out roll paper 11 toward the paper exit (see FIG. 9A). When the rear end of a region of roll paper 11 where a second ((n+1)-th) image is to be formed reaches the position closer to the paper exit relative to thermal head 12, photoprinter 1 stops drawing out roll paper 11 (see FIG. 9B). While thereafter drawing back roll paper 11 toward the paper feed source, photoprinter 1 starts to form a yellow image of the second ((n+1)-th) image (see FIG. 9C). At this time, the temperature of thermal head 12 is the first temperature.

Figure 10A:
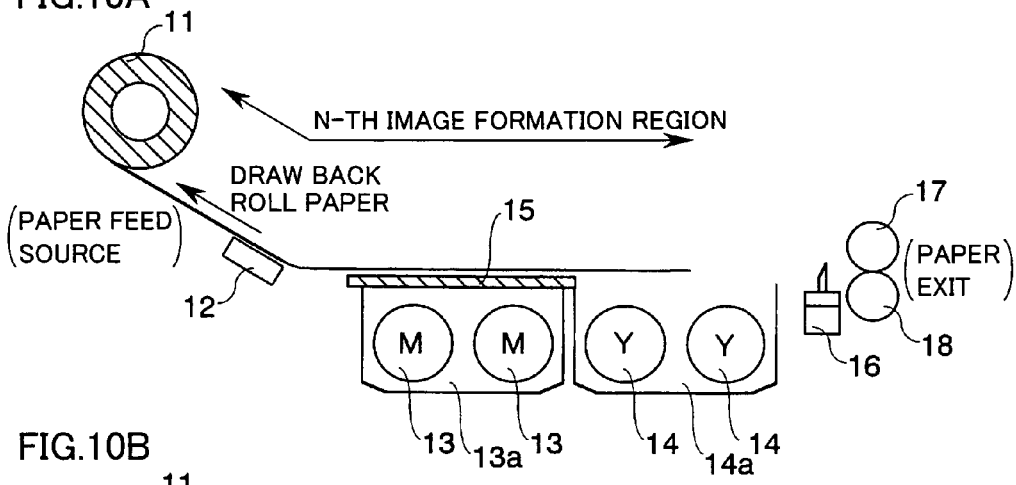
Figure 10B:
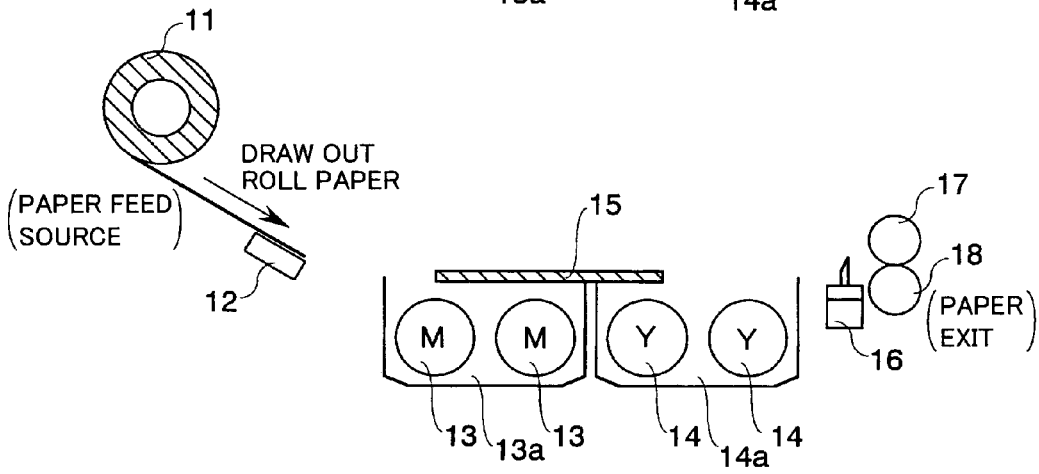
Figure 10C:
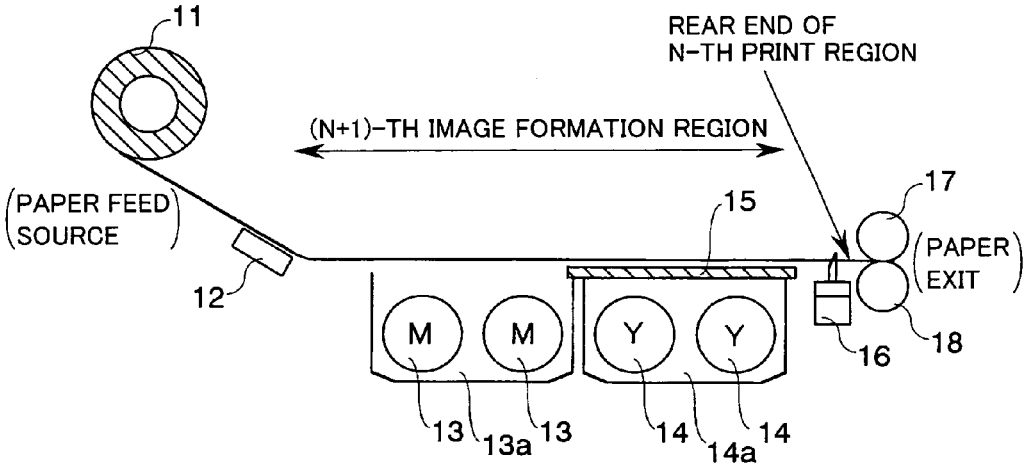
Figure 11A:
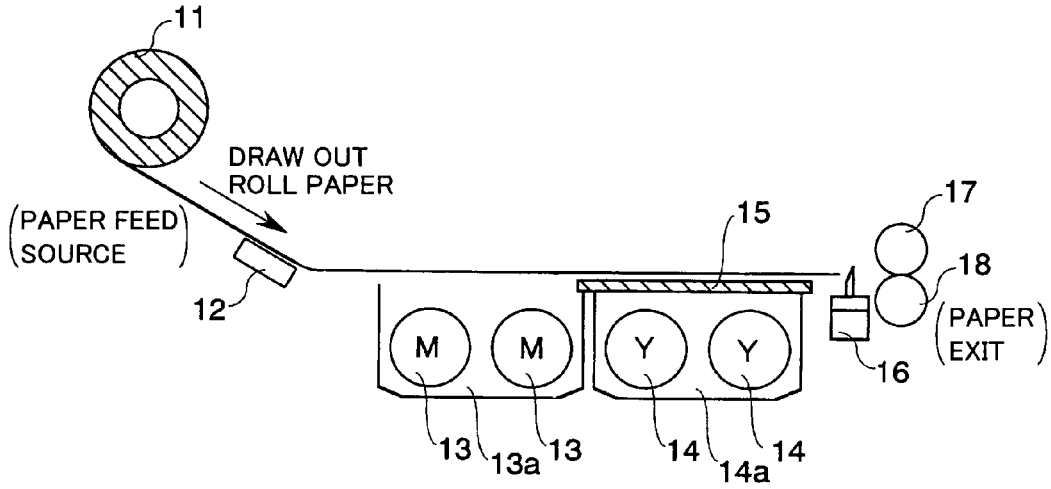
Figure 11B:
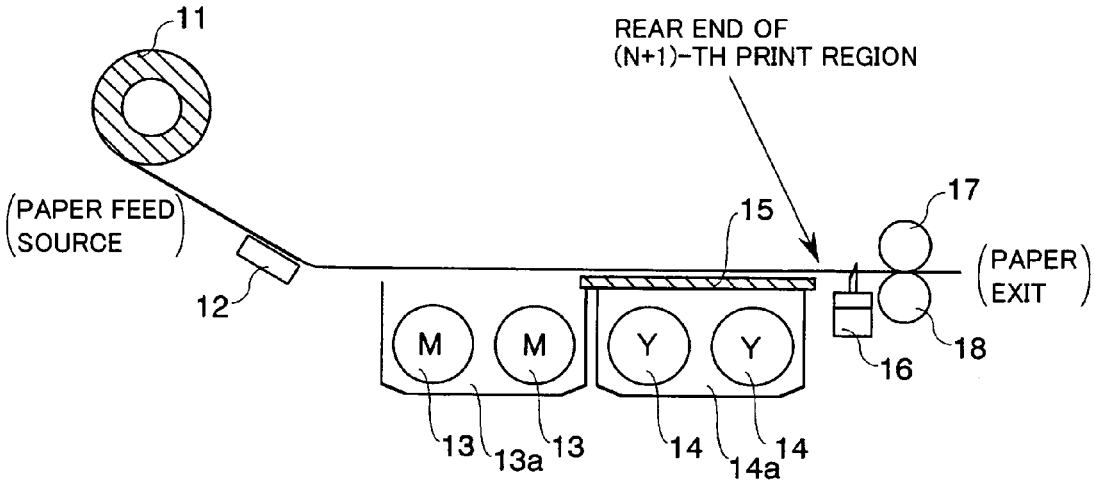

Even after formation of the second ((n+1)-th) yellow image is completed, photoprinter 1 does not stop drawing back roll paper 11 but raises the temperature of thermal head 12 to the third temperature for forming a cyan image on the region where the first image is printed (see FIG. 10A). After the formation of the first (n-th) cyan image is competed, photoprinter 1 stops the transport of roll paper 11 (see FIG. 10B). Roll paper 11 is then drawn out toward the paper exit. When the rear end of the region where the first (n-th) color image is printed is located closer to the paper exit relative to the position where cutting is effected by cutter 16, photoprinter 1 stops the transport of roll paper 11 (see FIG. 10C), moves cutter 16 in the direction of the width of roll paper 11 and separates the region having the first color image printed thereon from roll paper 11. The separated region of the paper is discharged by paper-discharge rollers 17 and 18. Photoprinter 1 thereafter draws out roll paper 11 toward the paper exit (see FIG. 11A). When the region of roll paper 11 where the second color image is to be printed reaches the yellow image fixing start position, photoprinter 1 stops the transport of roll paper 11 (see FIG. 11B). The state at this time is the same as that shown in and described in connection with FIG. 4C. Then, through the process including the steps shown in FIG. 5A to FIG. 7A, the yellow image and a magenta image of the second image are fixed on roll paper 11. Then, the steps starting from the step shown in FIG. 9A are repeated.

In this way, in printing a plurality of color images, photoprinter 1 forms the cyan image of the first (n-th) image and forms the yellow image of the second ((n+1)-th) image in one step of the process, so that the time required for printing color images can be shortened and convenience in the use by users can be improved in successively printing a plurality of color images.

Further, after formation of the yellow image of the second ((n+1)-th) image is completed, the cyan image of the first (n-th) image is successively formed without stopping the transport (drawing back toward the paper feed source) of roll paper 11, so that the time required for printing a plurality of color images can further be shortened.

Moreover, in the step of fixing the magenta image, photoprinter 1 stops transport of roll paper 11 and thereafter sufficiently exposes, with magenta image fixing lamp 13, the rear end of the region on which the first (n-th) color image is printed. Then, photoprinter 11 turns off magenta image fixing lamp 13 and thereafter moves roll paper 11 to the position where formation of the second ((n+1)-th) image is started. At this time, therefore, the region where the second ((n+1)-th) color image is to be formed is not exposed by magenta image fixing lamp 13.

When the last color image is formed, the steps shown in FIGS. 7B to 8C are followed after the step shown in FIG. 7A is completed.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A photoprinter comprising:

a transport unit for transporting roll paper set in a paper feed unit, said roll paper having thermal color-developing layers for yellow, magenta and cyan respectively formed on said roll paper;

a print unit having a thermal head, a magenta image fixing lamp and a yellow image fixing lamp that are arranged along a transport path along which said roll paper is transported, and operating said thermal head, said magenta image fixing lamp and said yellow image fixing lamp; and a control unit providing operation instructions to said transport unit and said print unit for printing a color image input to said photoprinter on said roll paper wherein, said control unit gives instructions to said transport unit and said print unit for printing the color image, said instructions are given to perform:

the first step of drawing out said roll paper toward a paper exit to an image formation start position, and thereafter drawing back said roll paper toward a paper feed source while setting temperature of said thermal head to a first temperature to form a yellow image on the thermal color-developing layer for yellow;

the second step of drawing out said roll paper toward the paper exit to a position where fixing of the yellow image is to be started, thereafter drawing back said roll paper toward the paper feed source while exposing the yellow image formed in said first step using said yellow image fixing lamp and fixing the yellow image;

the third step of drawing out said roll paper toward the paper exit to the image formation start position, and thereafter drawing back said roll paper toward the paper feed source while setting the temperature of said thermal head to a second temperature higher than said first temperature to form a magenta image on the thermal color-developing layer for magenta;

the fourth step of drawing out said roll paper toward the paper exit while exposing the magenta image formed in said third step using said magenta image fixing lamp and fixing the magenta image; and the fifth step of drawing back said roll paper toward the paper feed source while setting the temperature of said thermal head to a third temperature higher than the second temperature to form a cyan image on the thermal color-developing layer for cyan, when a plurality of color images are to be formed successively by said photoprinter, said control unit instructs to perform said first step through to said fifth step for printing an n-th color image of said plurality of color images, wherein said control unit instructs, after said n-th color image is processed by said transport unit and said print unit through said first step to said fourth step and after stopping drawing out of said roll paper for a certain period of time, to perform said first step for printing an (n+1)-th color image and drawing out said roll paper toward the paper exit to the image formation start position for said (n+1)-th color image, and when said first step for printing said (n+1)-th color image is completed, said control unit instructs to perform said fifth step for printing said n-th color image without stopping drawing back of said roll paper toward the paper feed source.

2. A photoprinter comprising:

a transport unit for transporting roll paper set in a paper feed unit, said roll paper having thermal color-developing layers for yellow, magenta and cyan respectively formed on said roll paper;

a print unit having a thermal head, a magenta image fixing lamp and a yellow image fixing lamp that are arranged along a transport path along which said roll paper is transported, and operating said thermal head, said magenta image fixing lamp and said yellow image fixing lamp; and a control unit providing operation instructions to said transport unit and said print unit for printing a color image input to said photoprinter on said roll paper wherein, said control unit gives instructions to said transport unit and said print unit for printing the color image, said instructions are given to perform:

the first step of drawing out said roll paper toward a paper exit to an image formation start position, and thereafter drawing back said roll paper toward a paper feed source while setting temperature of said thermal head to a first temperature to form a yellow image on the thermal color-developing layer for yellow;

the second step of drawing out said roll paper toward the paper exit to a position where fixing of the yellow image is to be started, thereafter drawing back said roll paper toward the paper feed source while exposing the yellow image formed in said first step using said yellow image fixing lamp and fixing the yellow image;

the third step of drawing out said roll paper toward the paper exit to the image formation start position, and thereafter drawing back said roll paper toward the paper feed source while setting the temperature of said thermal head to a second temperature higher than said first temperature to form a magenta image on the thermal color-developing layer for magenta;

the fourth step of drawing out said roll paper toward the paper exit while exposing the magenta image formed in said third step using said magenta image fixing lamp and fixing the magenta image; and the fifth step of drawing back said roll paper toward the paper feed source while setting the temperature of said thermal head to a third temperature higher than the second temperature to form a cyan image on the thermal color-developing layer for cyan, when a plurality of color images are to be formed successively by said photoprinter, said control unit instructs to perform said first step through to said fifth step for printing an n-th color image of said plurality of color images, and said control unit instructs, after said n-th color image is processed by said transport unit and said print unit through said first step to said fourth step, to perform said first step for processing an (n+1)-th color image, and thereafter perform said fifth step for processing said n-th color image.

3. The photoprinter according to claim 2, wherein when said first step for printing said (n+1)-th color image is completed, said control unit instructs to perform said fifth step for printing said n-th color image without stopping drawing back of said roll paper toward the paper feed source.

4. The photoprinter according to claim 2, wherein after said n-th color image is processed through said first step to said fourth step, said control unit instructs to perform, after stopping drawing out of said roll paper for a certain period of time, said first step for printing said (n+1)-th color image and drawing out said roll paper toward the paper exit to the image formation start position for said (n+1)-th color image.

5. The photoprinter according to claim 4, wherein when said first step for printing said (n+1)-th color image is completed, said control unit instructs to perform said fifth step for printing said n-th color image without stopping drawing back of said roll paper toward the paper feed source.

* * * * *